United States Patent [19]

Bartlett et al.

[11] Patent Number: 4,749,024

[45] Date of Patent: Jun. 7, 1988

[54] DIRECT CAST STRIP THICKNESS CONTROL

[75] Inventors: Edwin S. Bartlett, Worthington; Richard A. Wood, Columbus, both of Ohio

[73] Assignee: Battelle Development Corporation, Columbus, Ohio

[21] Appl. No.: 101,525

[22] Filed: Sep. 28, 1987

[51] Int. Cl.[4] ..... B22D 11/06

[52] U.S. Cl. ..... 164/463; 164/479; 164/423; 164/429; 164/437

[58] Field of Search ..... 164/463, 479, 429, 423, 164/488, 437, 428, 480

[56] References Cited

FOREIGN PATENT DOCUMENTS 0147912 7/1985 European Pat. Off. .

0198669 10/1986 European Pat. Off. ..... 164/463

*Primary Examiner*—Kuang Y. Lin

*Attorney, Agent, or Firm*—Barry S. Bissell

[57] ABSTRACT

Metal strip 3 may be cast directly from molten metal in an open tundish 2 onto a chill roll 1. Strip thickness is controlled by contouring the tundish lip 14 with an offset 10 near the casting wheel. This can be used remedially to offset the natural tendency for the strip to be thicker near the edges, which is undesirable for cold rolling, or it may be used creatively to produce contoured strip.

10 Claims, 3 Drawing Sheets

DIRECT CAST STRIP THICKNESS CONTROL

TECHNICAL FIELD

The invention relates to the production of metal sheet directly from the melt. In particular, it relates to casting of metal sheet on the outside surface of a chilled, cylindrical drum. A layer of melt is typically delivered to the casting surface by means of a tundish. The tundish is open at one end but is closely adjacent and mating with the casting surface on that end to deliver melt to the surface without leaking between the tundish and casting surface. The level of the melt, as well as other parameters of the casting run, affects the thickness of the cast strip. Before the present invention, the thickness tended to be greater at the edges due to a higher rate of heat extraction by the cooling drum at and near the edges of the strip relative to the center. Subsequent cold rolling of strip product generally requires the opposite contour, i.e., a strip which is slightly thicker in the center.

Prior EP Publication No. 0 147 912 has suggested that thicker strip may be produced by backing the tundish away from the casting wheel to increase the gap therebetween. This has its limits since liquid metal will drain out if the gap becomes too large. Moreover, there are times when a contoured thickness profile may be desired in the strip.

SUMMARY OF THE INVENTION

It is an object of the invention to provide a novel metal sheet-casting method.

It is further an object to provide such a method for directly forming metal sheet on a chilled casting drum from a melt in a tundish.

It is also an object to provide such sheet-casting method wherein the thickness of the sheet along its length and width is uniform.

It is also an object to provide a sheet-casting process wherein the thickness profile along its length and across the width is controllable without changing the gap between the tundish and wheel.

In accordance with the objectives of the invention is a method and tundish for casting metal sheet directly from the melt on a chilled casting surface. The apparatus comprises a tundish of the type having a backwall, opposed sidewalls and a floor therebetween and having the sidewalls and floor lip closely adjacent and contoured with the chilled casting surface. The tundish has a portion of the front lip of the floor removed by an offset away from the casting surface allowing a longer contact length of the melt with the casting surface and a thicker sheet in the area of the offset. A portion of the floor lip is retained across the tundish width so that the gap from the wheel remains the same for that remaining portion to retain the liquid metal. A preferred offset for producing a uniform thickness strip across the width is a bow-shaped offset taken from the upper surface of the floor downward. In general, the thickness of the strip is proportional to the depth of the offset. The desired thickness profile may be produced by a particular offset profile.

DESCRIPTION OF THE PREFERRED EMBODIMENTS

Figure 1:
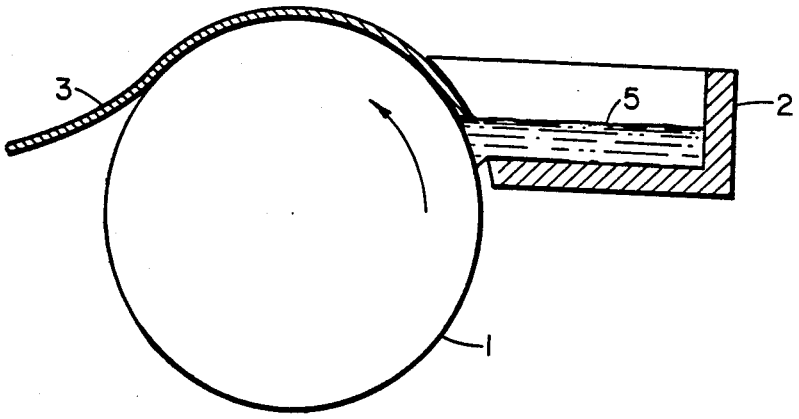
FIG. 1 is a schematic, elevation view of apparatus for casting sheet directly from the melt.

Known apparatus for forming near-net-shape metal sheet directly from the melt is shown in FIG. 1. The liquid metal 5 is contained in tundish 2. The sidewalls and floor of the tundish 2 on the open end are contoured and closely adjacent the casting surface to deliver a melt layer without leakage between the casting surface and the floor of the tundish.

Figure 2A:
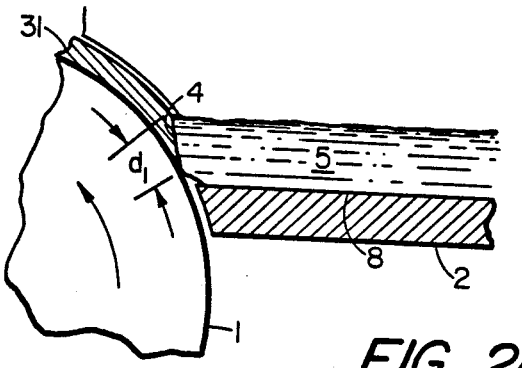
FIGS. 2(*a*) and 2(*b*) are enlarged views of the region between the prior art tundish floor and the casting surface wherein the gap is small and large, respectively.
Figure 2B:
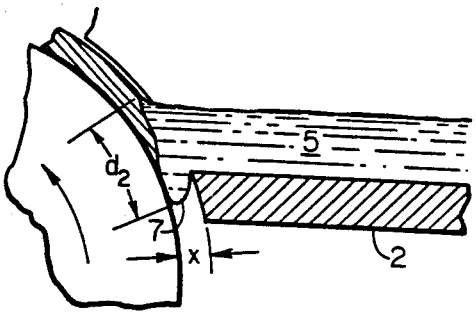

In FIGS. 2(*a*) and 2(*b*), the depth of the melt 5 affects the contact length $d_1$ along the chilled casting surface 1. As the melt contacts the casting surface for a sufficient time, a solidification front 4 is established between the melt 5 and the sheet 31. A heel 7 may form depending on the separation, x, of the tundish floor 8 and the casting surface, contributing to a slightly longer contact length $d_2$. The longer the melt contact length, the thicker the sheet. Introducing melt in the tundish to a greater depth will therefore contribute to thicker strip. But too large an inventory also has disadvantages. It is also known that increasing the separation or gap, x, also increases the contact length and strip thickness without increasing the depth of melt in the tundish.

It has been found that molten metal flow through the tundish has an important effect on the dimensional uniformity of the strip produced. Frictional forces along the tundish walls cause melt to move more slowly near the sides of the channel causing more heat loss. Moreover, there is essentially a bi-directional disposal of heat to the casing surface near the cast strip edges (radial and lateral) as opposed to essentially unidirectional (radial) loss near the strip center. This differential cooling results in a solidified strip with a "dog-bone" cross-sectional shape with the edges being thicker than the center. This strip profile is undesirable because it increases the number of processing steps and the cost for producing commercially acceptable rolled strip.

The present invention seeks in general to control the strip thickness to a uniform or desired non-uniform profile. In particular, it seeks to produce a rectangular or slightly convex cross section which is desirable for rolling. This is accomplished by controlling the distance over which solidification of the melt is allowed to occur. This distance is essentially the distance between the point at which the melt first contacts the wheel and the point where the solidified strip emerges from the casting pool. The upper point is therefore related to the upper level of the melt pool. The lower point is related to the level of the tundish floor and lip.

Figure 3:
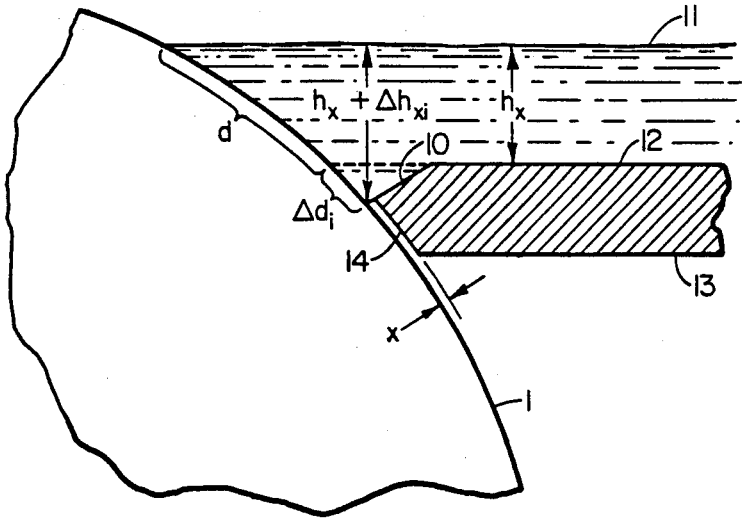
FIG. 3 shows an enlarged view of the casting region in the invention tundish with contoured lip.

As shown in FIG. 3, the solidification distance or contact length, d, may be controlled by contouring the lip 14 of the tundish floor. The tundish floor has an upper surface 12, a lower surface 13 and a lip 14 contoured to match the casting surface 1. The front face is spaced away from the casting surface by a fixed gap, x. Without the offset or cutout 10 from the lip 14, the depth of the melt 11 is $h_x$ and the solidification distance is d. With the angled offset 10 in the lip, the melt depth increases by an increment $\Delta h_{xi}$ and the solidification distance increases by $\Delta d_i$, at the ith transverse location causing an incremental increase in the strip thickness in that region.

In casting the metal strip, we have found that the thickness, M, is related to the solidification time, t, over the solidification distance, d, by the formula:

$$C_1M^2+C_2M-t=0 \quad (1)$$

The constants $C_1$ and $C_2$ are calculated from $$C_1 = \frac{\rho' H_f a}{2k'(T_m - T_s)}$$

$$C_2 = \frac{\rho' H_f a}{h_c(T_m - T_s)}$$

where $$a = \tfrac{1}{2} + \left[\tfrac{1}{4} + \frac{C_p'(T_m - T_o)}{3H_f}\right]^{\frac{1}{2}}$$

$T_m$ is the melting and freezing temperature of the metal $T_o$ is the steady state coolant temperature $H_f$ is the latent heat of fusion $\rho'$ is the density of the and melt $C_p'$ is the specific heat of the solid strip k' is the thermal conductivity of the strip $h_c$ is the effective heat transfer on the casting or solidified layer side of the mold-metal interface and is equal to $$h_c = \left(1 + \sqrt{\frac{k'\rho' C_p'}{k_p C_p}}\right)h$$

$H_f$ is the latent heat of fusion $T_s$ is the wheel-metal interface temperature. h is the global heat transfer coefficient and where k,$\rho$ and $C_p$ are the thermal conductivity, density and specific heat of the casting surface.

EXAMPLE 1

For a particular aluminum alloy cast on a steel wheel, we have calculated the constants $C_1$ and $C_2$ for steady state operation and reduced the equation (1) to $$14.9M^2+0.843M-t=0$$

Because the heat loss near the edges of the strip (approximately 2.5 cm) is bi-directional, the heat-transfer coefficients, and therefore the constants $C_1$ and $C_2$, will vary. Hypothetically, this may yield the following set of equations defining the conditions across the width of the strip:

| Location in Centimeters from Each Edge | Equation |
|---|---|
| 0–0.6 | $14.9\ M^2 + 0.733\ M - t = 0$ |
| 0.6–1.2 | $14.9\ M^2 + 0.760\ M - t = 0$ |
| 1.2–1.8 | $14.9\ M^2 + 0.788\ M - t = 0$ |
| 1.8–2.4 | $14.9\ M^2 + 0.816\ M - t = 0$ |
| 2.4 to center | $14.9\ M^2 + 0.843\ M - t = 0$ |

The time, t, is related geometrically to the system parameters by:

$$t = \frac{\alpha - \cos^{-1}(\cos\alpha + h_x/r)}{6\ \text{RPM}} \quad (2)$$

where $\alpha$=the zenith distance to the tundish lip, in degrees $h_x$=depth of liquid metal r=radius of casting wheel Looking at FIG. 3, a lip offset increases the pool depth by $\Delta h_{xi}$ at the $i^{th}$ transverse location across the lip and also increases $\alpha$ by $\Delta\alpha_i$ so that equation (2) becomes $$t_i = \frac{\alpha + \Delta\alpha_i - \cos^{-1}\left[\cos(\alpha + \Delta\alpha_i) + \frac{(h_x + h_{xi})}{r}\right]}{6\ \text{RPM}} \quad (3)$$

Since time=distance/velocity and d=r$\beta$ (r=arc radius=wheel radius; $\beta$=the angle transversed, in radians) and since the velocity and wheel radius are fixed, each value of $t_i(t+\Delta t_i)$ will define a value of $d_i(d+\Delta d_i)$ from which $\Delta\alpha_i$ can be calculated $$\Delta\alpha_i = \frac{\Delta d_i}{r}$$

Knowing $\Delta\alpha_i$ for the $i^{th}$ location allows the calculation of $\Delta h_{xi}$ using Equation 3. In fact, $\Delta h_{xi}$ is the vertical offset in the tundish lip at the $i^{th}$ location necessary to produce a thickness $M_i$ in the cast strip. Incremental values of $\Delta h_{xi}$ can be input to NC machinery to automatically contour the desired tundish lip.

The tundish lip may be profiled according to Table 1. To make a 30 cm wide, 0.1 cm thick (nominal) aluminum strip product on a steel wheel with a slight crown (0.097 cm edge symmetric about a 0.102 cm center) using the following process parameters Casting wheel radius=35.6 cm Casting speed=41 RPM=91.5 m/min Cooling water temperature −60° C.

x=45°

TABLE 1

TUNDISH LIP CONTOURING

| Position, i, (cm) | $th_1$, (mm) | $\Delta\alpha_i$ | $\alpha + \Delta\alpha_i$ | $h_x + \Delta h_{xi}$ (cm) | $\Delta h_{xi}$ (cm) |
|---|---|---|---|---|---|
| 0. | 0.965 | 0. | 45. | 4.72 | |
| 0.318 | 0.967 | 0.033 | 45.033 | 4.73 | 0.01 |
| 0.953 | 0.968 | 0.311 | 45.311 | 4.86 | 0.14 |
| 1.588 | 0.970 | 0.606 | 45.606 | 4.99 | 0.27 |
| 2.223 | 0.972 | 0.904 | 45.904 | 5.12 | 0.40 |
| 2.54 | 0.974 | 1.187 | 46.187 | 5.25 | 0.53 |
| 5.08 | 0.982 | 1.355 | 46.355 | 5.32 | 0.60 |
| 7.62 | 0.991 | 1.514 | 46.514 | 5.39 | 0.67 |
| 10.16 | 0.999 | 1.682 | 46.682 | 5.47 | 0.75 |

TABLE 1-continued

TUNDISH LIP CONTOURING

| Position, i, (cm) | $th_1$, (mm) | $\Delta\alpha_i$ | $\alpha + \Delta\alpha_i$ | $h_x + \Delta h_{xi}$ (cm) | $\Delta h_{xi}$ (cm) |
|---|---|---|---|---|---|
| 12.7 | 1.008 | 1.846 | 46.846 | 5.54 | 0.82 |
| 15.24 | 1.016 | 2.014 | 47.014 | 5.62 | 0.90 |
| 17.78 | 1.008 | 1.846 | 46.846 | 5.54 | 0.82 |
| 20.32 | 0.999 | 1.682 | 46.682 | 5.47 | 0.75 |
| 22.86 | 0.991 | 1.514 | 46.514 | 5.39 | 0.67 |
| 25.4 | 0.982 | 1.355 | 46.355 | 5.32 | 0.60 |
| 27.94 | 0.974 | 1.187 | 46.187 | 5.25 | 0.53 |
| 28.26 | 0.972 | 0.904 | 45.904 | 5.12 | 0.40 |
| 28.89 | 0.970 | 0.606 | 45.606 | 4.99 | 0.27 |
| 29.53 | 0.968 | 0.311 | 45.311 | 4.86 | 0.14 |
| 30.16 | 0.967 | 0.033 | 45.033 | 4.73 | 0.01 |
| 30.48 | 0.965 | 0. | 45. | 4.72 | 0. |

EXAMPLE 2

Figure 4:
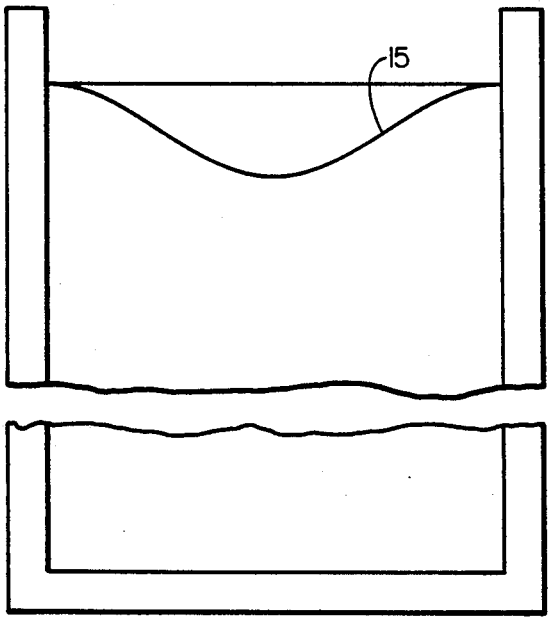
FIG. 4 is a plan view of a tundish having a sine-shaped offset according to the invention which would compensate for the edge-cooling effects on strip thickness.

FIG. 4 shows an alternative, smooth, sinecontour offset 15 which can produce a desirable strip profile. The following conditions were used to predict the contour shown in Table 2:

TABLE 2

| $i^{th}$ location, cm from edge | $t_i$, sec | $M_i$, mm |
|---|---|---|
| 0. | 0.0244 | 0.648 |
| 2.5 | 0.0245 | 0.650 |
| 5.1 | 0.0249 | 0.660 |
| 7.6 | 0.0255 | 0.697 |
| 10.1 | 0.0262 | 0.729 |
| 12.7 | 0.0268 | 0.756 |
| 15.25 | 0.0272 | 0.773 |
| 17.85 | 0.0274 | 0.778 |
| 20.5 | 0.0272 | 0.773 |
| 22.85 | 0.0268 | 0.756 |
| 25.4 | 0.0262 | 0.729 |
| 27.9 | 0.0255 | 0.697 |
| 30.25 | 0.0249 | 0.660 |
| 33.0 (edge) | 0.0245 | 0.650 |
| 35.5 | 0.0244 | 0.648 |

Aluminum wheel radius, =35.6 cm
Tundish location, =35.6°
Tundish width, x=35.6 cm
Head height, h=3.5 cm
Wheel speed=100 RPM Maximum offset desired (center)=0.95 cm to produce nominal 0.685 mm aluminum strip with the edges about 0.05 mm thinner than the center.

Figure 5:
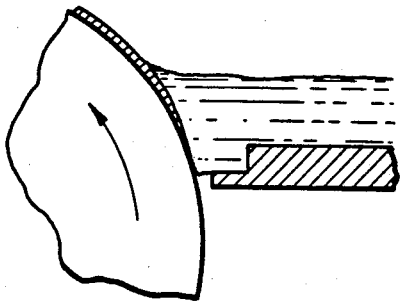
FIG. 5 is a side, sectional-cutaway view of an alternative tundish offset according to the invention.

FIG. 5 shows an alternative lip design for providing increased solidification distance according to the invention. Such offsets can extend transversely across the entire tundish or could be used only across a portion of the width to effect a variable thickness strip product.

Figure 6:
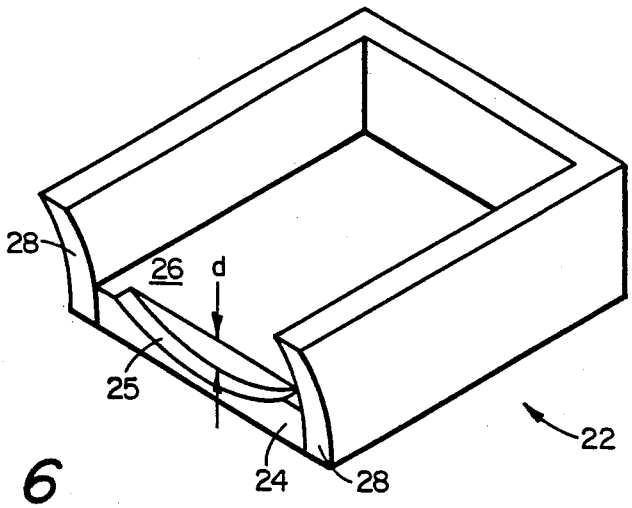
FIG. 6 is an isometric view of an alternative tundish having a bow-shaped offset taken from the upper surface of the floor downward.

FIG. 6 shows an isometric drawing of another tundish 22 with an alternative lip design in which an arcuate cutout 25 is taken in the lip from the tundish floor upper surface 26 downward. The remaining portions 24 of the lip and 28 of the sidewalls mate with the casting wheel to prevent leakage of the molten metal.

We claim:

1. Apparatus for direct casting of controlled thickness sheet from the melt on a chilled casting surface of the type comprising a molten-metal-containing tundish including a backwall, opposed sidewalls and a floor therebetween and having the sidewalls and floor closely adjacent and contoured with the chilled casting surface such that a layer of molten metal is delivered to the casting surface during casting wherein the improvement comprises a tundish wherein a portion of a lip of the floor adjacent the casting wheel including a portion of an upper surface of the floor contains a lip offset away from the casting surface allowing a longer solidification distance of the melt with the casting surface and a consequent thicker sheet in the vicinity of the offset.

2. The apparatus of claim 1 wherein the lip offset in the direction away from the casting surface is of uniform depth from the tundish floor upper surface downward to a point above a lower surface of the tundish floor.

3. The apparatus of claim 2 wherein the lip offset spans substantially the entire width of the tundish between sidewalls.

4. The apparatus of claim 1 wherein the lip offset in the direction away from the casting surface is of non-uniform depth from the tundish floor upper surface downward to points above the tundish floor lower surface.

5. The apparatus of claim 4 wherein the lip offset is of increasing depth from near the tundish sidewalls to near the center of the lip.

6. The apparatus of claim 5 wherein the locus of points along the offset is substantially sinusoidal.

7. A method for providing a desired thickness contour across the width of a metal sheet cast on a chilled casting surface directly from the melt comprising providing a tundish containing a pool of molten metal and including a backwall, opposed sidewalls, a floor therebetween wherein the floor and sidewalls are closely adjacent and contoured with the chilled casting surface such that the casting surface forms a barrier contacting the molten metal pool, removing a portion of a lip of the floor adjacent to casting wheel including a portion of an upper surface of the floor at desired locations, thus allowing greater depth of contact of the melt with the casting surface to control the sheet thickness profile across its width, and moving the casting surface through the melt pool thereby building a solidified layer of metal with the desired thickness contour on the casting surface.

8. The method of claim 7 including removing in the direction away from the casting surface a uniform depth portion of the lip from the tundish floor upper surface downward to a point above the tundish floor lower surface.

9. The method of claim 7 including removing in the direction away from the casting surface a non-uniform depth portion of the lip from the tundish floor upper surface downward to points above the tundish floor lower surface.

10. The method of claim 7 including removing a portion of increasing depth from the tundish sidewalls to near the center of the lip.

* * * * *